United States Patent [19]

Adler et al.

[11] Patent Number: 4,726,153

[45] Date of Patent: Feb. 23, 1988

[54] PORTABLE SHELTER

[75] Inventors: Aaron I. Adler; Earl Adler, both of Ville St. Laurent, Canada

[73] Assignee: Gazebo Penguin Inc., Montreal, Canada

[21] Appl. No.: 891,392

[22] Filed: Jul. 31, 1986

[51] Int. Cl.[4] ..... E04H 15/08

[52] U.S. Cl. ..... 52/63; 52/74; 52/82; 52/92; 52/222; 135/89

[58] Field of Search ..... 52/90, 92, 73–75, 52/204, 272, 273, 63, 82, 203, 222, 586; 135/89, 101, 119; 160/65, 83 R, 113; 403/180, 331

[56] References Cited

U.S. PATENT DOCUMENTS

| | | | |
|---|---|---|---|
| 651,251 | 6/1900 | Karr | 52/90 |
| 1,731,113 | 10/1929 | Siegel | 248/273 |
| 2,406,593 | 8/1946 | Dickelman | 52/94 |
| 3,118,186 | 1/1964 | Moss | 52/71 |
| 3,134,200 | 5/1964 | Moss | 52/745 |
| 3,286,404 | 11/1966 | Harrison | 52/75 |
| 3,300,941 | 1/1967 | Heirich | 52/721 |
| 3,333,373 | 8/1967 | Taylor et al. | 52/63 |
| 3,335,535 | 8/1967 | Lane | 52/204 |
| 3,446,220 | 5/1969 | Schafer | 135/89 |
| 3,952,463 | 4/1976 | Lane | 52/63 |
| 3,997,945 | 12/1976 | Rosins | 24/129 R |
| 4,028,888 | 5/1977 | Upton et al. | 160/66 |
| 4,171,013 | 10/1979 | Clark | 160/22 |
| 4,192,112 | 3/1980 | Reilly | 52/222 |
| 4,576,192 | 3/1986 | Duda | 135/89 |

*Primary Examiner*—John E. Murtagh
*Assistant Examiner*—Andrew Joseph Rudy
*Attorney, Agent, or Firm*—Diller, Ramik & Wight

[57] ABSTRACT

A gazebo and a lean-to shelter have rigid panels with a soft material canopy spread over an arrangement of spokes or ribs. The gazebo has a compression spoke arrangement for holding the canopy in a dome configuration. The spokes of the gazebo include a flat hook underneath each spoke adapted to engage a draw cable at the top periphery of the rigid panels, and a sleeve fits over the end of the spoke and the end of the flat hook to lock the draw cable within the hook. A tip engages the end of the tube and the sleeve to lock it in position on the flat hook. The ribs of the lean-to have a toggle arrangement for extending the ribs when the lean-to shelter has been assembled and to apply tension on the canopy. The end of the toggle is adapted to fit in a rail which in turn also receives the edge of the canopy, and the rail is mounted in a track.

3 Claims, 9 Drawing Figures

28
32
30
46
44
12
19
38
24
26
66
116
106
102
108
110
162
114
118
104
100
112
62
64
98
96
94
84
92
90
88
76
82
72
74
80
78
68
70
W
154
156
158
160

PORTABLE SHELTER

BACKGROUND OF THE INVENTION

1. Field of the Invention

The present invention relates to portable shelters and the like, and more particularly, to an improved prefabricated shelter of the type having rigid side wall panels and a soft fabric canopy.

2. Description of the Prior Art

It is well known to provide prefabricated portable shelters of the type referred to as a gazebo with a plurality of rigid upstanding wall members each provided with screened openings, the walls forming a polygon. A canopy of fabric or plastic material covers the space, without the benefit of a central support, and overhangs the periphery formed by the upstanding walls. Examples of similar structures are shown in U.S. Pat. No. 3,118,186, issued Jan. 21, 1964 to Moss; U.S. Pat. No. 3,134,200, issued May 26, 1964 to Moss; U.S. Pat. No. 3,333,373, issued Aug. 1, 1967 to Taylor et al; U.S. Pat. No. 3,335,535, issued Aug. 15, 1967 to Lane; and U.S. Pat. No. 3,952,463, issued Apr.27, 1976 to Lane. Such structures also employ bowed, tensioned roof spokes or ribs connected centrally to a hub and hook-shaped tips at the outer ends of the spokes adapted to engage a draw wire retaining the top edges of the upstanding wall panels. However, such hook-shaped tips may be shaken loose of the draw wire under windy and especially gusty conditions.

SUMMARY OF THE INVENTION

It is an aim of the present invention to provide a shelter of the gazebo type which is an improvement over the shelters referred to above.

It is also an aim of the present invention to provide an improved lean-to shelter having screen type upstanding wall panels, a flexible roof or canopy and improved means for attaching the shelter to an existing installation.

A construction in accordance with the present invention comprises a portable shelter having a plurality of rigid panels adapted to be arranged in a closed polygon, each of the panels having a channel along the top edge thereof and a draw cable threaded through said channels to lock said panels in said closed polygon. A dome-shaped roof includes a framework of flexible ribs extending radially from a central hub, and each rib includes means at its outer end for engaging the rigid panels and for retaining the framework under compression. A flexible canopy overlies the framework and is adapted to overhang beyond the rigid panels. The improvement comprises the means for engaging the rigid panels being in the form of a flat hook on the underside of the rib having a hook element connected to the rib and having its free end extending outwardly relative to the hub to define a bight open outwardly. The hook element is spaced inwardly from the outer end of the rib and is adapted to engage the draw cable between the channels on respective rigid panels such that a portion of each rib overhangs beyond the rigid panels, and a sleeve slideable on the rib is adapted to engage the free end of the hook element in such a way as to lock the draw cable within the hook means.

The outer end of the rib, in the form of a hollow tube, may have a one-piece molded tip member having a shank adapted to fit within the tube, a washer acting as a stop member for the sleeve member, and a nipple extending axially therefrom adapted to engage grommets in the canopy to maintain the canopy under tension on the framework and overhung beyond the rigid panels.

In another aspect of the present invention, a lean-to shelter comprises a plurality of rigid panels adapted to surround an area adjacent an existing installation, wherein the installation has at least a vertical wall. A framework of parallel ribs extends from the wall to a series of rigid panels mounted parallel to the vertical wall. Rail means mount the framework to the vertical wall, and an attachment means connects the ribs to the rigid panels in a manner such that the ribs overhang the rigid panels. A flexible canopy overlies the framework. The improvement includes a toggle means interrupting each rib such that the ribs can be extended or retracted in a manner to apply tension on the canopy; rail means including a first elongated member adapted to be fixed to the vertical wall and including an elongated socket of circular cross-section and provided with a continuous slot; and a second member having a resilient elongated bead adapted to fit in the socket and an elongated neck extending through the slot. The second member comprises an elongated track member including a channel for receiving the ribs and an elongated socket of circular cross-section adapted to receive a bead formed in the canopy.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 3, 4:
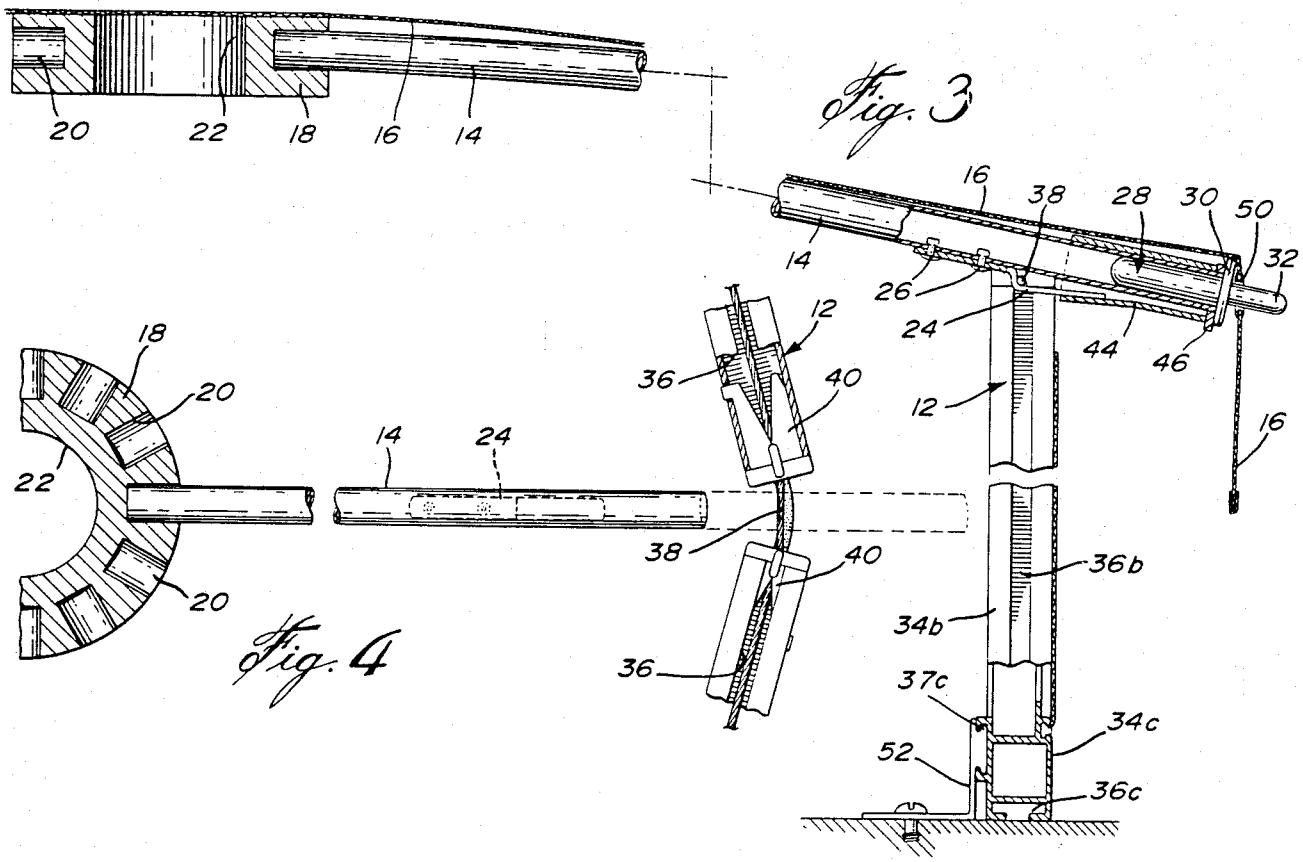
FIG. 3 is a fragmentary enlarged side elevation partly in cross-section, taken of a detail of the embodiment shown in FIG. 1.
FIG. 4 is a top elevation of the detail shown in FIG. 3.

Referring now to the embodiment illustrated in FIGS. 1 and 3 through 6, there is illustrated a gazebo 10 in the form of a polygonal structure made up of rigid panels 12 forming the polygon. Spokes 14 form a canopy frame mounting a canopy 16 over the top of the gazebo. The canopy frame includes, as shown in FIGS. 3 and 4, a hub 18 in which a central opening 22 has been formed and a plurality of radial blind bores 20. Each radial bore 20 is adapted to receive the end of a spoke 14.

The spokes 14 are in the form of a hollow tube, and as shown in FIGS. 3 and 4, mount a flat hook 24 riveted to the underside of the spoke by means of rivets 26. The hook 24 is open towards the outer end of the spoke 14 and is adapted to receive a draw cable 38 as will be described. A tip 28 having a radial flange 30 is adapted to fit in the end of the tubular spoke 14. The tip 28 includes a nipple 32 extending axially therefrom. A sleeve 44 is also adapted to fit over the spoke 14 and to pass over the end of the hooks 24 as will be further described. The sleeve 44 is held onto the spoke 14 by means of the tip 28.

Figure 6:
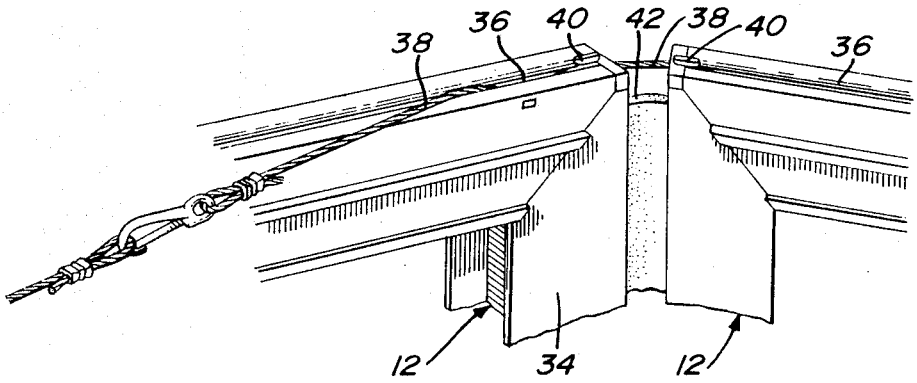
FIG. 6 is an enlarged fragmentary perspective view of a detail shown in FIG. 4.

The rigid panels 12 are made up of aluminum extrusions forming the panel frame, and the body of the panel may be an insect screen or glass panes. The frame is made up of a series of identical extrusion pieces 34 (identified in FIG. 3 as members 34*b* and 34*c*). The extrusion 34 on the top of the panel, as shown in FIG. 6, includes a channel 36 which is adapted to receive a draw cable 38. The draw cable 38 is held within the extrusions 36 by means of locking inserts 40 which are more clearly illustrated in FIG. 4. Finally, the extrusion along the bottom edge of the rigid panel 12, identified as 34*c*, includes a side channel 37*c*. If the gazebo is mounted on a man-made floor platform, such as a wood platform or concrete, a floor bracket 52, which is fixed to the platform, can be provided, which is adapted to fit within the channel 37*c* and thereby anchor the rigid panels 12. In the event the gazebo is mounted on a lawn or other earth surface, anchor spikes in the form of tent pegs may be utilized to anchor the bottom extrusion 34*c*.

The spokes 14 are mounted radially from each radial bore 20 in the hub 22. The spokes, being longer than the distance between the hub 18 and the draw cable 38, are held in compression by arranging the hooks 24 to receive the draw cable 38 which passes about the periphery of the panels 12 in the channels 36. Each spoke 14 passes between a pair of adjacent panels 12 which are separated by flexible webs 42. The spoke assembly so held suspends the central hub 18 and maintains the canopy 16 in a dome shape. The hook 24, once it is engaged with the draw cable 38, is then blocked by having the sleeve 44 pass thereover. The sleeve 44 has an end portion which is out of the round so as to engage the end of the hook 24. A washer 46 is held against the sleeve 44 at the end of the tube of the spoke 14, and the tip 28 is forced into the end of the spoke 14 holding the washer against the sleeve 44. The nipple 22 passes through a grommet in the canopy 16, thereby holding the canopy 16 in position over the spoke arrangement. An overhanging skirt is provided as shown in the drawings. The hook locked in the manner described is positively engaged on the draw cable 38, thereby preventing the spokes 14 from disengaging from the cable 38 even in high, gusty winds.

Figure 1:
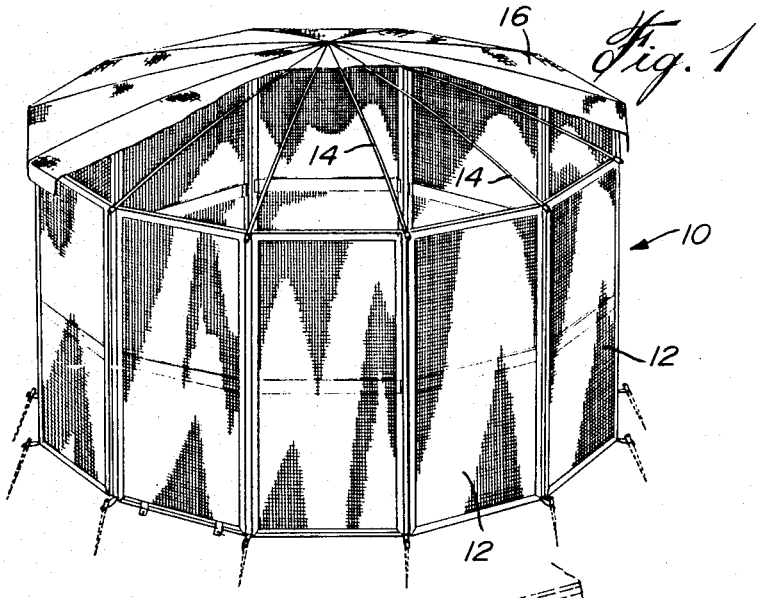
FIG. 1 is a perspective view partly cut away, showing a gazebo in accordance with the present invention.
Figure 2:
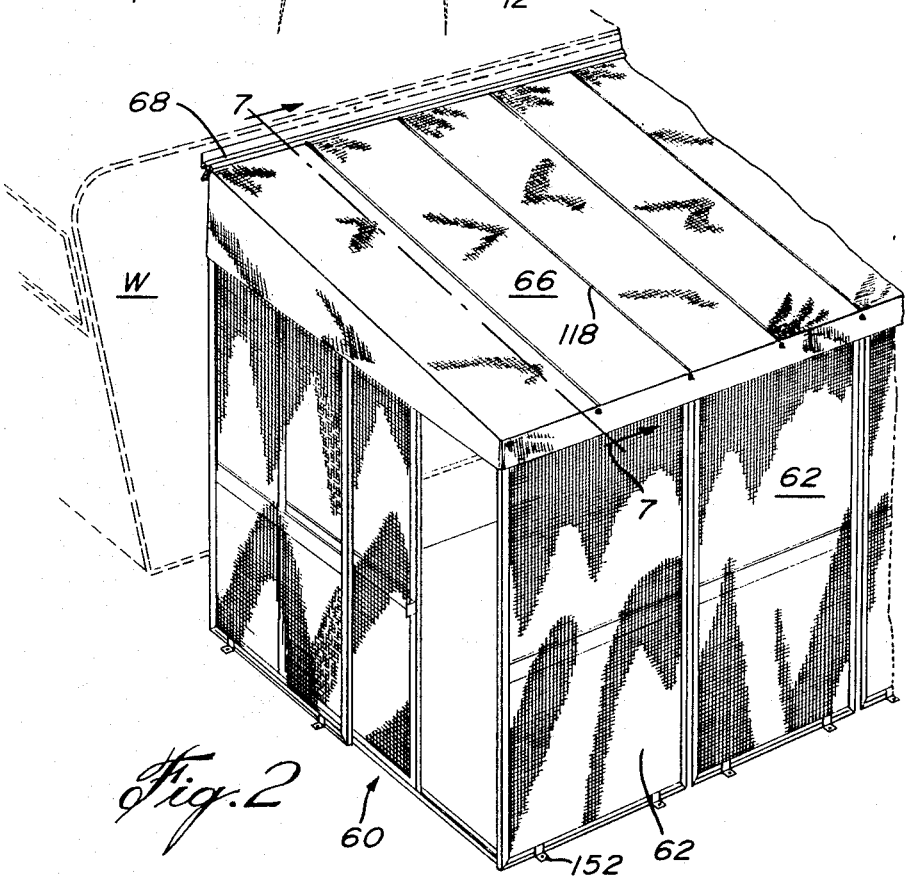
FIG. 2 is a fragmentary perspective view of a lean-to shelter in accordance with the present invention.
Figures 5, 7, 9:
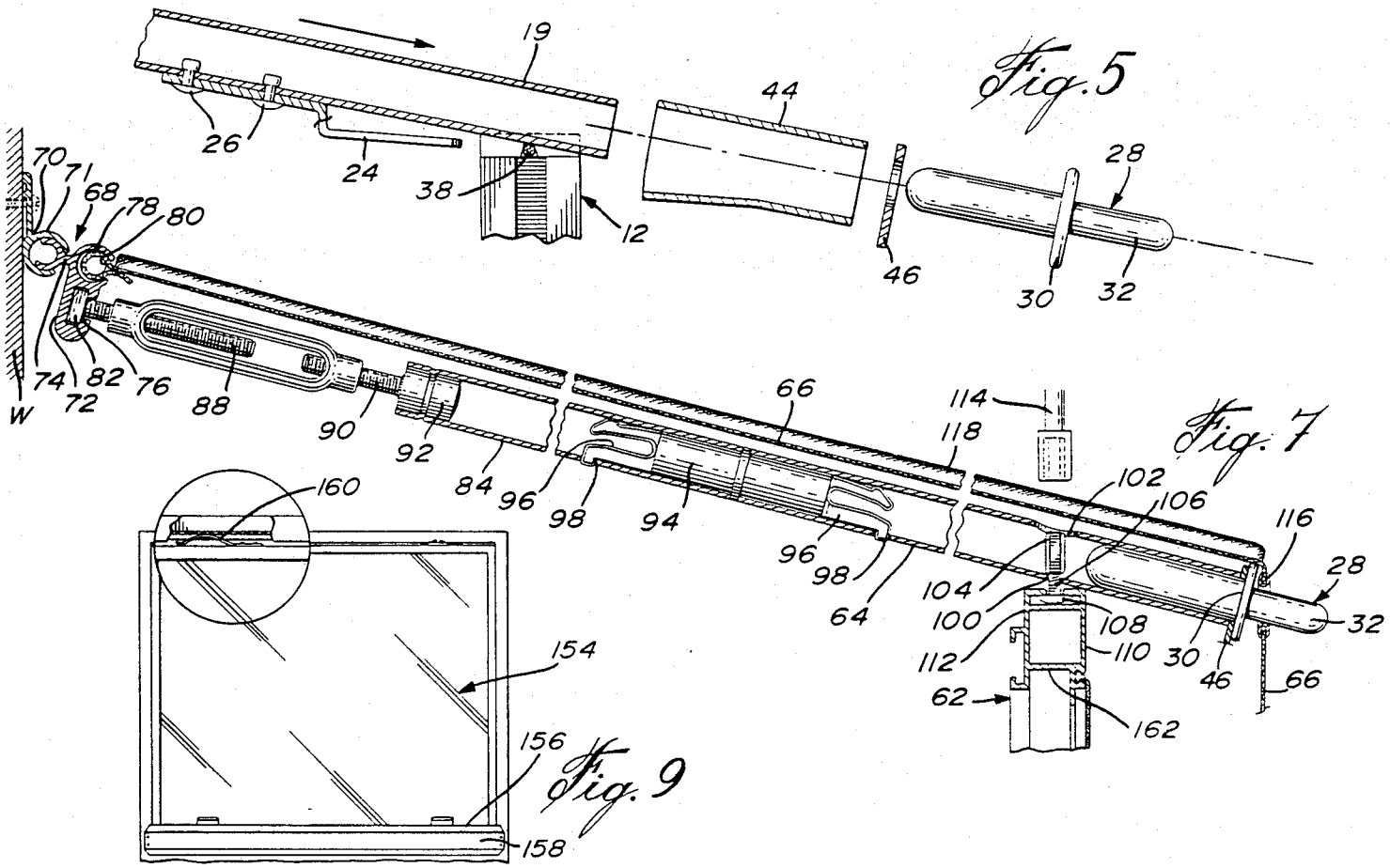
FIG. 5 is a fragmentary exploded enlarged view of the detail shown in FIG. 3.
FIG. 7 is a vertical fragmentary cross-section taken along line 7—7 of FIG. 2.
FIG. 9 is a fragmentary front elevation of a detail of an embodiment of the present invention.
Figure 8:
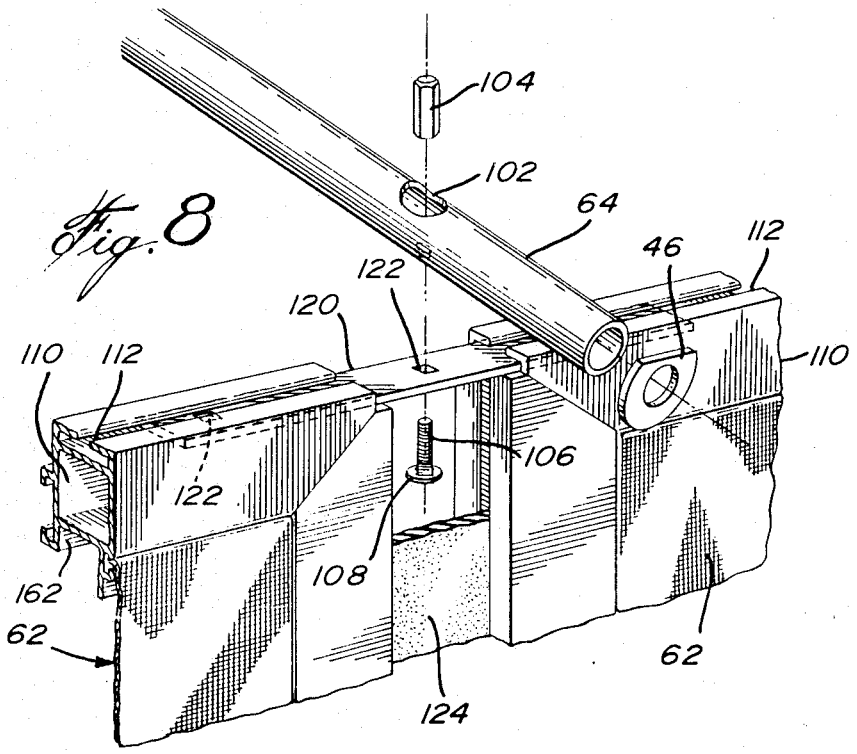
FIG. 8 is a fragmentary enlarged perspective view partly exploded showing a detail shown in FIG. 7.

The lean-to shelter is illustrated in FIGS. 2, 7 and 8. The lean-to shelter 60 includes a plurality of rigid panels 62 which are constructed similarly to the panels of the gazebo 10. A rail 68 is adapted to be mounted on a wall of a structure, and a plurality of parallel ribs 64 extends from the rail in a sloped fashion to the top edge of the rigid panels 62 opposite the wall W. A canopy 66 extends over the ribs above the enclosure formed by the rigid panels 62.

The rail 68 includes a wall bracket 70 adapted to be fixed to the wall W. The wall bracket has a flat member and a circular open socket 71. A separate rail member 72 includes a bead 75 which can be received in the circular socket 71. The rail member 72 includes a neck 74, a circular socket 78, and a channel 76. The canopy 66 is provided with a bead 80 adapted to be received in the circular socket 78. The rail member 72 is an elongated extruded member as is the wall bracket 70.

Each rib 64 includes a hollow tube 84 of relatively rigid construction. At one end of the tube 84 is a toggle 86 which includes a threaded shank 88 to which is mounted a bolt head 82 adapted to be received in the channel 76 of the rail 72. A threaded shank 90 is also threaded to the toggle 86 and includes a head 92 which is crimped within the end of the tubes 84. A connector member 94 can connect two tube members 84 forming the ribs 64. The connector 94 includes spring legs 96 adapted to engage in openings 98 in the tube 84.

Near the outer end of the rib 64, an aperture 100 is provided, and this aperture 100 is aligned with a larger access aperture 102 at the top of the rib, as shown in FIG. 7. A carriage bolt including a shank 106 and a head 108 is adapted to be received in the channel 112 of an extrusion 110 on the top of the rigid panel 62. The carriage bolt passes through the opening 100 and is locked therein by means of a hexagonal nut 104 which is passed inside the tube 84 through the access opening 102. The ribs 64 are arranged in parallel and may also be placed between two adjacent panels 62 as shown in FIG. 8. In this case, a bar 120 is fitted in the channels 112 of adjacent panels, and the bar 120 includes a square hole 122 through which the carriage bolt 106–108 will pass.

The tip 28, of identical structure to that described in relation to the gazebo 10, is provided to fit in the end of the tube 84. The nipple 32 is designed to pass through a grommet 116 in the canopy 66 in the same manner as that described with the gazebo 10. When the ribs have all been installed, the toggles 86 will be rotated in order to extend the ribs and apply tension on the canopy 66. The canopy 66 can be constructed such that the seams 118 of individual panels forming the canopy extend upwardly, thereby providing drainage channels in the canopy so formed.

The panels 62 may be anchored to the ground or decking. Bracket 152, shown in FIG. 2, would normally be located on the inside of the enclosure formed by the panels 62. They have been shown on the outside of the bottom edge of the panels 62 for illustrative purposes only.

FIG. 9 shows the option of mounting a wind screen in a panel 12 or 62. This is especially useful when the panel is provided with insect screens. The wind screen 154 can fit in a channel 156 provided in midway frame member 158. The top edges of the wind screen include bowed spring members 160 which fit into the channel 162 of top extrusion 110. The wind screen 154 can be easily inserted on the panel 62.

We claim:

1. A portable canopy defined as a lean-to shelter comprising a plurality of rigid panels adapted to surround an area adjacent an existing installation, wherein the installation has at least a portion of a vertical wall, a framework of parallel ribs extending from the wall to a series of said rigid panels mounted parallel to the portion of the vertical wall, rail means mounting the rib framework to the vertical wall, and attachment means connecting the ribs to the rigid panels in a manner such that the ribs overhang the rigid panels, a flexible canopy overlies the framework, the improvement including a toggle means interrupting each rib such that the ribs can be extended or retracted in a manner to apply or release tension on the canopy, and the rail means inlcude a first elongated member adapted to be fixed to the vertical wall, including an elongated socket of circular cross-section provided with a continuous slot; a second elongated member having a resilient elongated bead adapted to fit in the socket of said first elongated member and a neck connected to the bead and extending through the slot, whereby the second elongated member can pivot relative to the first member, the second member comprising an elongated track member mounted to the neck and the track including a channel for receiving the ribs and a parallel elongated socket of circular cross-section adapted to receive a bead formed in the canopy, whereby the rib framework and the canopy thus connected to the second elongated member can pivot in unison relative to the first member.

2. A lean-to shelter as defined in claim 1, wherein each rigid panel has an extrusion extending along the top thereof with a track having a longitudinal slot receiving the head of a fastener, the fastener passing through a respective rib.

3. A lean-to shelter as defined in claim 1, wherein the toggle means includes a threaded shank with a bolt head adapted to be recieved within the channel, and the toggle is mounted at the end of a hollow tube forming the rib.

* * * * *